US010221565B2

(12) United States Patent
Boucher et al.

(10) Patent No.: US 10,221,565 B2
(45) Date of Patent: Mar. 5, 2019

(54) HIGHLY INSULATED FLOOR-TO-CEILING WINDOW

(71) Applicant: AGC GLASS EUROPE, Louvain-la-Neuve (BE)

(72) Inventors: Nicolas Boucher, Gosselies (BE); Olivier Bouesnard, Ittre (BE); Pierre Schneider, Romagne (FR); Francois Closset, Jalhay (BE)

(73) Assignee: AGC GLASS EUROPE, Louvain-la-Neuve (BE)

( * ) Notice: Subject to any disclaimer, the term of this patent is extended or adjusted under 35 U.S.C. 154(b) by 0 days.

(21) Appl. No.: 15/757,579

(22) PCT Filed: Aug. 22, 2016

(86) PCT No.: PCT/EP2016/069779
§ 371 (c)(1),
(2) Date: Mar. 5, 2018

(87) PCT Pub. No.: WO2017/036834
PCT Pub. Date: Mar. 9, 2017

(65) Prior Publication Data

US 2018/0245341 A1 Aug. 30, 2018

(30) Foreign Application Priority Data

Sep. 4, 2015 (EP) ..... 15183891
Jun. 13, 2016 (EP) ..... 16174104

(51) Int. Cl.
*E04B 2/88* (2006.01)
*E06B 3/663* (2006.01)

(52) U.S. Cl.
CPC ..... *E04B 2/88* (2013.01); *E06B 3/663* (2013.01); *E06B 3/66304* (2013.01)

(58) Field of Classification Search
CPC ..... E04B 2/88; E06B 3/663; E06B 3/66304
See application file for complete search history.

(56) References Cited

U.S. PATENT DOCUMENTS 5,260,112 A 11/1993 Grether et al.
5,853,828 A 12/1998 Schimmelpenningh et al.
8,375,680 B2 * 2/2013 Clair ..... E06B 3/5436 52/204.593

(Continued)

FOREIGN PATENT DOCUMENTS

CN 104583522 A 4/2015
EP 0 470 373 A1 2/1992

(Continued)

OTHER PUBLICATIONS

International Search Report dated Oct. 4, 2016 in PCT/EP2016/069779 filed Aug. 22, 2016.

*Primary Examiner* — Babajide A Demuren
(74) *Attorney, Agent, or Firm* — Oblon, McClelland, Maier & Neustadt, L L P

(57) ABSTRACT

A floor-to-ceiling window for a building, the window including insulating glazing units having transparent vertical elements when the glazing units adjoin each other. The joints between the glazing units allow for a slight relative movement between glazing units while ensuring sealing tightness of the window from wind and weather.

18 Claims, 4 Drawing Sheets

(56) References Cited

U.S. PATENT DOCUMENTS

| | | | | |
|---|---|---|---|---|
| 8,596,024 | B2 * | 12/2013 | Trpkovski | E06B 3/66309 52/786.13 |
| 8,679,598 | B2 * | 3/2014 | Veerasamy | E06B 3/6612 428/34 |
| 2007/0178257 | A1 | 8/2007 | Landon | |
| 2009/0000247 | A1 | 1/2009 | Demars et al. | |
| 2015/0135627 | A1 | 5/2015 | Mottelet et al. | |

FOREIGN PATENT DOCUMENTS

| | | | |
|---|---|---|---|
| EP | 1 984 594 | A1 | 10/2008 |
| EP | 2 855 814 | A1 | 4/2015 |
| GB | 2 241 013 | A | 8/1991 |
| TW | 351737 | B | 2/1999 |
| TW | 200744969 | A | 12/2007 |

* cited by examiner

HIGHLY INSULATED FLOOR-TO-CEILING WINDOW

1. TECHNICAL FIELD OF THE INVENTION

The present invention relates to an insulating glass wall for a building, in particular the insulating glass walls having multiple panels which equip showrooms, halls of public and commercial buildings, verandas, pergolas and glass roofs. Nevertheless, any other application which requires such large-sized glass walls having properties of efficient thermal insulation and sufficient resistance to wind and other atmospheric conditions also falls within the scope of the invention.

2. STATE OF THE ART

Large glass walls which equip showrooms and halls of public and commercial buildings are already known. In certain cases, such as, for example, in the case of car dealership showrooms, these glass walls are generally formed by the juxtaposition of large glass sheets separated by connection elements which are more or less visible, and they can occupy up to the entire area of one or even several of the walls of a building. Such glass walls enable good visibility of the cars displayed. However, in countries where the winters are cold, this poses the difficult problem of the significant heat loss linked to the high overall thermal conduction properties of large areas of glass.

Patent Application EP 0 470 373 discloses a multiple glazing comprising polymeric spacers as surround of the glazing and a double tightness seal between these spacers and the glass sheets. An additional tightness seal in the form of a thin metal band is applied to the spacer at the interface with the external atmosphere. A vapourtight adhesive is also injected into all the cavities located between the spacer and the metal band. This disclosure contains no suggestion of assembling several multiple glazings together. Furthermore, this patent application discloses nothing with regard to the possible transparency of the spacers and seals.

Patent Application GB 2 241 013 is also known, which application discloses a double glazing having transparent edges which can be combined with an identical glazing by means of a transparent silicone adhesive. This adhesive is used to join adjacent panels. However, nothing is disclosed with regard to the structural and tightening functions of the joint.

A glass wall which would be formed of several known glazings would, however, exhibit at least one of the following disadvantages:

incomplete transparency, insufficient tightness to water and to wind, insufficient durability and insulation of the panels.

3. Objectives of the Invention

It is an objective of the invention to overcome the disadvantages of known glass walls by providing a novel glass wall which:

limits heat losses from the building by using transparent materials of polymer type and by dispensing with metal frame elements. These materials make it possible to obtain increased thermal insulation performances with respect to solutions involving metal parts;

as little as possible obscures the view, for an observer, of objects located on the other side of the glass wall. The use of transparent elements makes it possible to provide a solution without visual interruption due to the vertical parts of an opaque frame;

meets the criteria of tightness and of durability of panels of these types;

and provides a stiffness of the surface and more generally sufficient resistance and sufficient tightness to wind and to water.

Another advantage of the glass walls in accordance with the invention is that they can be easily combined with systems for the mechanical fixing of glazings of various types (with mechanical anchoring to the edges of the glazings or pointwise anchoring,with a glueing system), as well as with systems for reinforcing by bracing, without, however, disadvantaging the observer's view.

4. SUMMARY OF THE INVENTION

To this end, the invention relates to a glass wall of a building comprising at least two fixed glass panels, the panels being formed of a multiple insulating glazing formed of several glass sheets, the said glazing comprising:

a. two horizontal spacers between each glass sheet;

b. at least one transparent vertical spacer on an edge contiguous with another panel;

c. a first double horizontal peripheral seal between the horizontal spacers and each glass sheet;

d. a second horizontal peripheral seal;

e. at least one first transparent double vertical peripheral seal between the transparent vertical spacer and each glass sheet;

f. an internal space between the glass sheets delimited by the horizontal spacers and vertical spacers comprising a covering of insulating gas, according to which a. the horizontal spacers and vertical spacers are connected by at least one tightness element in order to form a spacer frame;

b. at least one second vertical peripheral seal contiguous with the first seal is non-transparent and leaktight to water vapour and to the insulating gas of the internal space;

c. two contiguous panels are connected by at least one seal base contiguous with the second vertical peripheral seal of each panel;

d. the second vertical peripheral seal contiguous with the first transparent vertical seal is free from tensile stress and/or from shear with respect to the adjacent panel;

e. a tightness lining is located between the glass sheets of two contiguous panels and is in contact with the seal base;

f. the glass wall is devoid of vertical rigid frame element in the vicinity of the edge of the glazing contiguous with the transparent spacer.

5. LIST OF THE FIGURES

FIG. 1 diagrammatically illustrates a horizontal section in a glass wall according to the invention.

FIG. 2 diagrammatically illustrates an insulating panel 2 comprising a spacer frame 12.

6. DETAILED DESCRIPTION OF THE INVENTION

Figure 1:
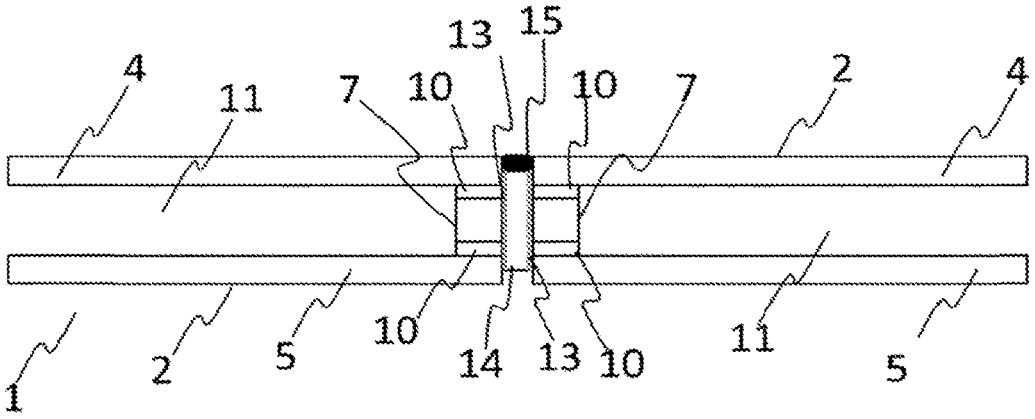

"Glass wall" is understood to denote a glass surface occupying the whole of an opening made in a wall or a roof of a building. Such a glass wall does not have an opening to the atmosphere external to the building and is formed of several panels of glasses assembled together. Said glass wall is of fixed and non-opening nature.

The glass wall in accordance with the invention comprises at least two glass panels, that is to say two elements made of glass, with a flat or curved surface, which are assembled in order to form the glass wall. Flat surface panels are preferred. Often, the glass wall comprises more than two panels positioned side-by-side over one or more rows. The form of these panels is generally a polygon and most often of square or rectangular form. The panels can also take any other form comprising any number of straight and/or curved edges. Preferably, the panels of the glass wall are polygons with at least four sides.

The glass panels are fixed, that is to say devoid of the possibility of opening to the atmosphere external to the building. According to the invention, each glass panel is a multiple glazing which comprises several glass sheets. These glass sheets exhibit a thickness ranging from 0.5 mm to 15 mm (for example, soda-lime-silica glass sheets with a thickness of 4 or 8 mm) combined via a spacer frame which holds them at a certain distance from one another. In the case of a triple glazing, the central glass sheet generally has a lower thickness than the other two sheets. According to the invention, the glass sheets can be of different sizes. The use of glass sheets of different sizes makes it possible in particular to produce angled glass walls, opening glazings and also glazings with bracing systems. "Angled glass wall" is understood to mean a glass wall, at least two contiguous panels of which are not in the same plane and thus form an angle different from 180° between them.

Generally, the glass wall in accordance with the invention comprises at least two double or triple glazings.

The multiple glazings are insulating glazings, that is to say multiple glazings which limit the heat exchanges between the inside of the building and the external surroundings.

According to the invention, the multiple glazing comprises spacers which hold the glass sheets parallel at a certain distance from one another. This glazing comprises two horizontal spacers between each glass sheet. The horizontal spacers are positioned along the top and bottom edges of the glazing. In the situation where the panels cover the complete height of the glass wall, these spacers are not generally transparent. They can contain desiccative material used to guarantee the absence of moisture in the glazing throughout its period of use.

The horizontal spacers are composed of at least one profile. "Profile" is understood to denote an object of elongated form and of unvarying section. The profile is generally made of metal, of polymer, of ceramic or of composite material (combination of at least two different materials). The metals used are generally chosen from galvanized steels, stainless steels and aluminium alloys. The profile is preferably a polymeric foam profile comprising particles of desiccative material. Examples of such foams are silicone foams or foams of ethylene/propylene/diene monomer polymers (EPDM polymers). A foam profile which is highly suitable is the Super Spacer® Triseal profile.

Hollow profiles can also be used. In this case, the desiccative material will at least partially fill the hollow space. Examples of desiccative materials capable of filling the hollow space are silica gels and molecular sieves. Examples of hollow profiles which are suitable are the TGI-Spacer® profile (stainless steel/polypropylene composite) and the Chromatech® Ultra profile (stainless steel/rigid polymer composite).

The glazing of a panel of the glass wall also comprises at least one transparent vertical spacer on an edge contiguous with another panel. The term "transparent" denotes a property illustrating the percentage $T_L$ (light transmission) of visible light transmitted through the glazing in the visible spectrum of at least 1%. Preferably, transparent relates to a $T_L$ property of at least 10%. Ideally, transparent denotes a $T_L$ of at least 50%. The term "contiguous" denotes elements located in the immediate vicinity of one another.

The adjectives vertical and horizontal are understood to denote locations close to opposite edges, that is to say non-contiguous edges of the frame and/or of the glazing, and which are facing each other.

The glazing of a panel of the glass wall also comprises a first and a second horizontal peripheral seal. The first of these seals is always a double seal located between the horizontal spacers and each glass sheet. The second is a seal located directly between the glass sheets, which surmounts the horizontal spacer and is flush with the glass sheets. The term "peripheral" indicates that the seals are located in the vicinity of the edges of the glazing. These seals ensure the tightness of the glazing to gases and to moisture. These seals can be opaque or transparent. They are generally opaque.

The glazing of a panel of the glass wall also comprises at least one first and at least one second vertical peripheral seal. The first vertical peripheral seal is also a double seal located between the transparent vertical spacer and each glass sheet. This double seal is transparent.

The second vertical peripheral seal is contiguous with the first vertical peripheral seal. It is non-transparent and leak-tight to water vapour and to the insulating gas of the internal space.

This second peripheral seal should ideally exhibit a thickness which is as low as possible, so as not to be too excessively detrimental to the overall transparency of the glass wall. Preferably, the second peripheral seal does not extend over the external faces of the glass sheets. A material of choice for producing this seal is, for example, a metal strip or a metallized polymer band which is not very sensitive to UV radiation, coated with a thin layer of adhesive on one face. The metal used is preferably stainless steel or aluminium.

In a glazing of the glass wall, an internal space is delimited by the glass sheets, the horizontal and vertical spacers and their peripheral seals. This space is filled with a covering of insulating gas. The gas of the internal space is an inert gas capable of thermally insulating the glazing. A suitable inert gas is chosen for its absence of toxicity to living beings, of corrosive nature with regard to the glazing, of flammable nature and of sensitivity to UV radiation. Such a gas is generally chosen from air, argon, xenon, krypton and their mixtures. Generally, use will be made of air, argon or a mixture of air and argon. According to a preferred embodiment of the invention, the internal space comprises a covering of an insulating gas comprising at least 85% of argon.

The glass wall according to the invention is characterized in that the horizontal and vertical spacers are connected by at least one tightness element in order to form a spacer frame.

"Tightness element" is understood to denote elements which connect together, in the corners of the panels, the horizontal spacers to the vertical spacers. This element is made of at least one watertight material so that its contribution to the tightness of the multiple glazing comprising this element maintains a mean moisture penetration index $I_{av}$ ≤20% following the ageing test described in Standard EN1279-2:2002. Examples of these materials are: isobutylene polymers, a thin metal strip or a composite which are adhesive on one of their faces, a single or double-sided adhesive tape made of acrylic polymer. Preferably, this material also participates in the gastightness so that, according to Standard EN1279-3:2002, the multiple glazing exhibits a gas leakage rate $L_i$, expressed as % per volume of gas i and per year, ≤1.00% per year on conclusion of the ageing test described in the standard.

In the glass wall according to the invention, two contiguous panels are connected by at least one contiguous seal base to the second vertical peripheral seal of each panel.

"Seal base" denotes an elastic seal which interacts with the tightness lining, which will be referred to below, the function of which is to limit the thickness of this lining and to contribute to guaranteeing its geometry by preventing contact of the latter with the peripheral seals.

The materials used to produce the seal base are generally chosen at least from rubbers, EPDM polymers, butadiene/styrene elastomers, extruded silicones, acrylic polymers, or polyurethane (PUR) or polyethylene (PE) foams. Materials of this list can be opaque or transparent. Preferably, a material in this list which is transparent is used.

In this glass wall, the second vertical peripheral seal contiguous with the first transparent vertical seal is free from tensile stress and/or from shear with respect to the adjacent panel.

According to the invention, a tightness lining is located between the glass sheets of two contiguous panels and is in contact with the seal base.

This lining connects the glass sheets external to the building of two contiguous panels in order to provide watertightness and airtightness of the glass wall. In an alternative form, it can also connect the glass sheets internal to the building of two contiguous panels. It is also possible to provide a lining both between the glass sheets external to the building and the sheets internal to the building. Generally, the lining connects the external glass sheets.

The lining is made of a mastic having a tightening function, such as silicone, polyurethane (PU), modified silicone (MS-Polymer) or acrylic polymers. These mastics have a good mechanical strength, in addition to their properties of watertightness and airtightness and of adhesion to the glass. They exhibit a possibility of elastic deformation of at least 10% of movement capacity according to Standard ISO 9047, and preferably of at least 25% and most preferably of at least 50%. Preferably, this lining is a translucent silicone exhibiting a good resistance to UV radiation. The term "translucent" denotes a material which allows incident light to pass without, however, clearly transmitting the image of the objects located beyond.

The seal base and the tightness lining are such that they provide, on the one hand, the external tightness of the glass wall and, on the other hand, leave the second vertical peripheral seal free from tensile stress and/or from shear with respect to the adjacent panel.

According to the invention, the glass wall is also devoid of vertical rigid frame element in the vicinity of the edge of the glazing contiguous with the transparent spacer. This final characteristic of the invention reinforces the fact that it provides an ideal solution to the maximum visibility through the glass wall.

According to a first embodiment of the glass wall in accordance with the invention, the seal base is a flexible element, at least one surface of which in contact with the second peripheral seal of one of the two panels is juxtaposed without adhering with the second peripheral seal of the other panel.

According to a more specific embodiment, this seal is transparent and acts as support for the deposition of the tightness lining.

In another embodiment of the glass wall, two contiguous panels are connected by two juxtaposed seal bases which do not adhere to one another. In this case, the two seal bases are generally produced by polymer bands comprising an adhesive face and a non-adhesive face. The non-adhesive face of each seal base is contiguous with the other seal base, while the other face adheres to the second non-transparent vertical peripheral seal of the glazing of the adjacent panel. Polymer bands which are suitable are, for example, acrylic polymer bands.

Another embodiment, compatible with the preceding embodiments, consists in that the seal base and the tightness lining of the glass wall are made of a transparent resin. In this case, the transparent resins have to be different in order to ensure, on the one hand, the external tightness of the glass wall and, on the other hand, to leave the second vertical peripheral seal free from tensile stress and/or from shear with respect to the adjacent panel.

According to yet another embodiment, the second horizontal peripheral seal is a mastic having a structural function. It is chosen from silicone, polyurethane (PU), polysulphides or modified silicone (MS-Polymer). These mastics have a very good mechanical strength, in addition to their properties of watertightness and airtightness and of adhesion to the glass. This second peripheral seal is also known as sealing seal. "Structural function" is understood to mean the ability to transfer the mechanical stresses related in particular to the weight of the glass sheets to the thermal expansion stresses.

Yet another embodiment compatible with the preceding embodiments consists in that the transparent vertical spacer comprises at least one transparent polymer which is rigid at ambient temperature. "Polymer which is rigid at ambient temperature" is understood to mean a polymer, the glass transition temperature $T_g$ of which is at least 50° C. Preferably, the polymer chosen has a $T_g$ of at least 65° C. Most preferably, the polymer has a $T_g$ of at least 80° C. Examples of such polymers are a polymethyl methacrylate (PMMA), a polycarbonate (PC), a polystyrene (PS), a polyvinyl chloride (PVC), a polyamide (PA), a polyetherimide (PEI), a polyethylene terephthalate (PET), a styrene/acrylonitrile (SAN) copolymer, a poly(acrylonitrile-co-butadiene-co-styrene) (ABS) or a blend of these compounds. Preferably, the transparent and rigid polymer is chosen from a PMMA, a PC, a PS, a PVC, an ABS, a PA or a blend of these compounds. More preferably still, the transparent spacer is formed from PMMA or from PC. These polymers are characterized by a high transparency and a high processability. The term "polymer" covers in this instance both polymers and copolymers.

According to yet another embodiment of the glass wall, also compatible with the preceding embodiments, the glass wall is characterized in that the transparent double vertical peripheral seal is chosen from a second list of transparent materials, different from the first, consisting, for example, of a double-sided adhesive tape made of acrylic polymer, made of rubber or made of silicone, a polyisobutylene-based adhesive or an adhesive of crosslinkable acrylic or crosslinkable epoxy type. Preferably, a double-sided adhesive tape made of acrylic polymer is used.

"Crosslinkable" is understood to mean the fact of forming a three-dimensional network of polymer chains under the action of ultraviolet radiation, of moisture or of a curing agent. These materials, in addition to being transparent, exhibit a good performance in terms of tightness to water vapour and gases and in addition exhibit good adhesion to the glass while withstanding ultraviolet rays.

According to yet another embodiment of the glass wall in accordance with the invention, itself also compatible with the preceding embodiments, the glass wall is characterized in that the first horizontal peripheral seal is chosen from tightness mastics, such as based on polyisobutylene, more commonly known as "butyl", or a double-sided tape made of acrylic polymer, of rubber or of silicone, or a combination of the two. This type of seal is particularly effective in terms of tightness to water vapour and gases. Preferably, a polyisobutylene-based mastic is used.

In another embodiment compatible with the preceding ones, the glass wall according to the invention comprises a third horizontal peripheral seal. This third horizontal peripheral seal covers the second horizontal peripheral seal and at least partially the horizontal portions of the glass sheets. According to a specific alternative form, this third horizontal peripheral seal entirely covers the horizontal portions of the glass sheets and the second horizontal peripheral seal. According to another specific alternative form, this third horizontal peripheral seal entirely covers the horizontal portions of the glass sheets and the second horizontal peripheral seal and extends over the external faces of the glass sheets.

This third horizontal peripheral seal comprises at least one single-sided metallic adhesive tape. When there are several tapes, these are superimposed.

This tape can optionally be combined with a coating on its face contiguous with the second horizontal peripheral seal. Coatings which are suitable are, for example, a polyisobutylene-based coating, an acrylic coating or a combination of the two. This tape can optionally be a tape having a good tear strength, which exhibits an advantage during the installation in a frame element. An example of such an adhesive tape is Vitominium PET230.

Preferably, the metal of the tape is aluminium. An advantageous alternative form is that consisting in coating the metal tape with a first layer of acrylic polymer and subsequently a second layer of polyisobutylene-based coating. This second layer of polyisobutylene coating can advantageously contact the second horizontal peripheral seal and the glass sheets.

The presence of this third horizontal peripheral seal advantageously makes it possible to improve the gastightness and watertightness of the glass wall while furthermore not harming the transparency of the latter. This is because, in the case where this seal does not extend over the external faces of the glass sheets, the transparent surface of the glass wall is not affected. In the case where this seal extends over the external faces of the glass sheets, it will be masked by a frame element. In this case again, the improvement in the tightness is reinforced by the extension over the external faces of the glass sheets.

Another embodiment, still compatible with the preceding ones, is also that of a glass wall comprising a second vertical peripheral seal which is at least one single-sided metallic adhesive tape. It can also comprise several tapes. When there are several tapes, these are superimposed.

This tape can optionally be combined with a coating. Coatings which are suitable are, for example, a polyisobutylene-based coating, an acrylic coating or a combination of the two. This tape can optionally be a tape having a good tear strength, which exhibits an advantage during the installation in a frame element. An example of such an adhesive tape is Vitominium PET230.

Preferably, the metal of the tape is aluminium. An advantageous alternative form is that consisting in coating the metal tape with a first layer of acrylic polymer and subsequently a second layer of polyisobutylene-based coating. This second layer of polyisobutylene coating can advantageously contact the transparent vertical spacer, the first vertical peripheral double seal and the glass sheets.

In the glass wall in accordance with the invention and according to each of the preceding embodiments, a primer can also be applied, in an alternative form, on at least one of the following surfaces:

- the glass sheets at the interface between these and the first double transparent vertical peripheral seal,
- the transparent vertical spacer at the interface between this and the first double transparent vertical peripheral seal,
- the edge face of the glass sheets.

The term "primer layer" is understood to denote a layer of an organic product which adheres well to the peripheral seal and which has selective adhesive properties with respect to the glass or the transparent resin of which the spacer is made. Examples of such primers are the compounds of the family of the silanes and the compounds of the family of the acrylic resins. "Good adhesion" is understood to mean an adhesion which requires a positive tearing-off force in order to separate the two assembled parts and for which the failure of the two parts together is cohesive, as described in Standard EN1279-4:2002.

A primer which has given excellent results is the primer VHB AP115® from 3M.

Another alternative embodiment of the glass wall according to the invention comprises at least one tempered and/or laminated glass sheet. This is because it is possible, for safety reasons, for the glass sheets to be tempered glass sheets or laminated glass sheets. The latter sheets comprise a stack of at least one sheet made of polyvinyl butyral (PVB) plastic sandwiched between two glass sheets. Such stacks of laminated glasses are provided with total glass thicknesses (not including the thickness of the PVB sheet(s)) ranging from 4 mm up to and including 24 mm.

As regards its insulating properties, the glass wall according to the invention, including in its preceding embodiments, comprises at least one panel which exhibits a heat transfer coefficient Ug ranging from 0.3 to 1.8 $W/m^2$.

The use of multiple glazings makes it possible to optimize the energy efficiency of the glass wall. The thermal insulation is usually determined by the overall performance qualities of a glass element as multiple glazing, which are defined by Ug, the heat transfer coefficient of the glazing (calculated according to Standards EN673 and ISO10292). "Heat transfer coefficient Ug" is understood to mean the amount of heat passing through the glazing, under steady state conditions, per unit of surface area, for a difference of one degree Celsius between the surroundings, for example exterior and interior. Several factors can improve this Ug coefficient, for example layers of low-e type deposited on the glass sheets and, preferably, on their interior faces, that is to say the faces in contact with the gas covering. Another factor is the nature of the insulating gas. For example, the glass sheets used can be glass sheets of Thermobel® type coated with one or more metal layers, for example the TopN® or TopN+T® layers (AGC registered trademarks). The TopN+T® layers are preferred. According to an advantageous use of the invention, compatible with all the preceding uses, the insulating glazing exhibits a heat transfer coefficient Ug of at least 0.3, preferably of at least 0.6 and most preferably of at least 1.0 $W/m^2$. The heat transfer coefficient Ug is generally of at most 1.8 $W/m^2$.

Generally, the glass sheets coated with layers are edge deleted, in particular in order to prevent corrosion of the layers at the periphery of the glazing, which can bring about aesthetic and mechanical disadvantages. They thus exhibit a peripheral band with a different appearance. In the case of conventional glass walls comprising horizontal and vertical frame elements, this peripheral band is masked by the frame elements. In the case of glass walls in accordance with the invention, which are devoid of vertical rigid frame element between contiguous panels, this band with a different appearance represents an aesthetic disadvantage.

According to a specific embodiment of the invention where the glass wall comprises both the second vertical peripheral seal and the third horizontal peripheral seal, glass sheets coated with layers and not edge deleted can be used. The layers are advantageously those described above. This is because the presence of the second vertical peripheral seal and of the third horizontal peripheral seal, exhibiting watertightness, makes it possible to protect the layers at the periphery from corrosion and thus makes it possible to dispense with the edge deletion. The use of such glass sheets, which thus do not exhibit a peripheral band with a different appearance, exhibits an aesthetic advantage for glass walls in accordance with the invention which are devoid of rigid vertical frame element between contiguous panels.

In this embodiment, the second vertical peripheral seal and the third horizontal peripheral seal are as described above. When the single-sided metallic adhesive tape is combined with a coating, the watertightness is found to be advantageously strengthened thereby.

In yet another alternative form of the glass wall according to the invention, at least one glass sheet is partially covered with a decorative layer chosen from ceramic inks and organic inks. Preferably, the decorative layer is an opaque ceramic ink, more commonly known as enamel, which masks the spacer frame and also the peripheral seals. Generally, the enamel is applied by screen printing on one of the faces of at least one glass sheet. Preferably, the enamel layer is applied to the glass sheet which is located on the side external to the building. More preferably still, the enamel layer is applied to the internal face of this glass sheet, that is to say the face in contact with the internal space.

Preferably also, the horizontal spacers and the horizontal peripheral seals of the panels of the glass wall are masked by the decorative layer deposited on the glass sheet.

The glass wall in accordance with the invention, included in this its various embodiments, can also comprise vertical spacers which are connected to the horizontal spacers by at least one stiffening element.

Generally, "stiffening element" should be understood as meaning the combination of at least one metal, polymeric or ceramic part or part made of composite material with a pressure device, an adhesive, a pin, a screw or any other means providing bonding between the said spacers. The adhesive can be selected from adhesives made of crosslinkable acrylic polymers, crosslinkable epoxy adhesives, double-sided adhesive tapes made of acrylic polymer and polyisobutylene-based adhesives. The screw can be made of steel, of zinc-coated steel, of stainless steel or of bronze. According to a specific embodiment of the invention, the stiffening element is formed of a profile different in nature and/or in form from the horizontal spacer. Another alternative form consists also in combining the horizontal spacer with pieces of profiles positioned non-continuously, forming blocks which make up the stiffening element.

In an alternative form, the stiffening element is in contact with at least the second horizontal peripheral seal. According to the concrete form adopted for the stiffening element, the contacting operation is carried out over a portion only or over the whole of the external surface of this element. For example, in the case of a profile with a square or rectangular section, the profile can be immersed completely in the second horizontal peripheral seal.

According to an advantageous embodiment of the invention, the stiffening element has a form of a profile extending over the entire length of at least one horizontal spacer. Preferably, the stiffening element is a profile with a square or rectangular section. More preferably, it is glued to the horizontal spacer using a double-sided adhesive tape made of acrylic polymer.

The glass wall in accordance with the invention can be employed for various applications, such as:

a. a curtain wall;

b. a glazing with bracing beam;

c. a glass roof.

In the case of the application in a curtain wall, the panels can be fixed to the supporting structure by various fixing means. These means can, for example, be mechanical anchoring to the edges of the glazings, pointwise fixing or any glueing system. Examples of these fixed glazings are: structural "glazing" and attached or stapled external "glazing". The word "glazing" employed here in these terms denotes the glass sheet of a panel, external to the building, in contact with the external atmosphere.

7. DESCRIPTION OF THE FIGURES

FIG. 1 diagrammatically illustrates a section in a glass wall according to the invention. A glass wall 1 comprising two glass panels 2 is made out therein. Each glass panel 2 is composed of two glass sheets 4, 5, of a transparent vertical spacer 7, of a first double transparent vertical peripheral seal 10 on the glass sheet/transparent vertical spacer interfaces, of an internal space 11 and of a second non-transparent vertical peripheral seal 13. The glass wall also comprises a non-adherent seal base 14 separating the glass panels 2 and a tightness lining 15 located between the glass sheets 4, 4 of each panel 2 in contact with the atmosphere external to the building. Another possible implementation is also to use a seal base 14 which adheres to just one of the two panels 2.

Figure 2:
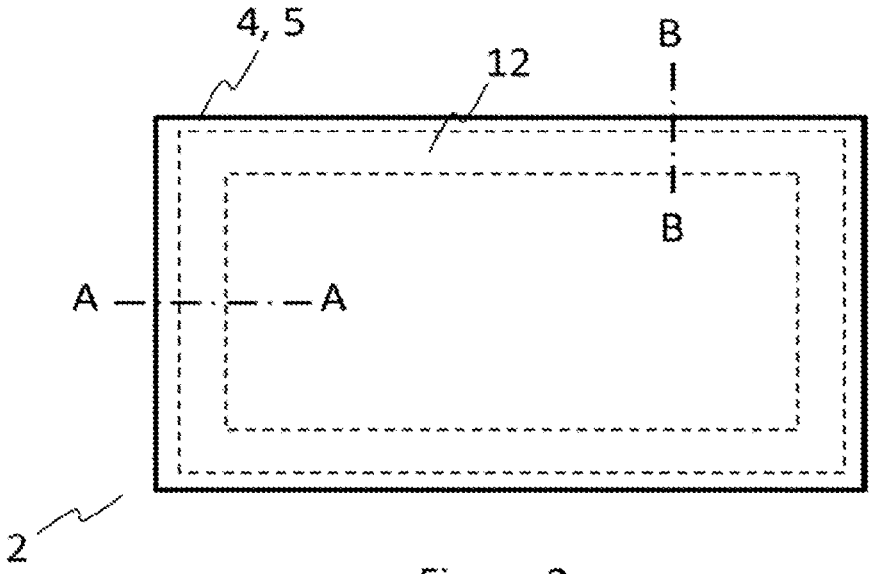

FIG. 2 diagrammatically represents a glass panel 2 of the glass wall seen from the front. A spacer frame 12 formed by the horizontal spacers 6 and the vertical spacers 7 (not represented) is made out therein.

Figure 3:
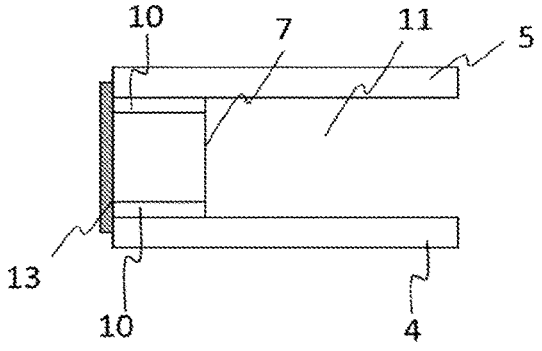
FIG. 3 illustrates a section along a plane AA in the panel of FIG. 2.

FIG. 3 illustrates a section along a plane AA in the panel of FIG. 2. This figure describes the following elements: two glass sheets 4, 5, a transparent vertical spacer 7, a first transparent vertical peripheral seal 10 at each glass sheet 4, 5/transparent vertical spacer 7 interface and a second non-transparent vertical peripheral seal 13. The second non-transparent vertical peripheral seal 13 is contiguous with the portions of the two glass sheets 4, 5, with the edges of the double transparent vertical peripheral seal 10 and with the transparent vertical spacer 7.

Figure 4:
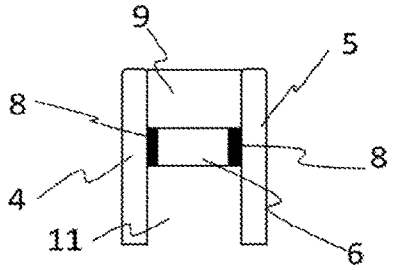
FIG. 4 illustrates a section along a plane BB in the panel of FIG. 2.

FIG. 4 illustrates a section along a plane BB in the panel of FIG. 2. This figure describes the following elements: two glass sheets 4, 5, a horizontal spacer 6, a first horizontal peripheral seal 8 at each glass sheet 4, 5/horizontal spacer 6 interface and a second horizontal peripheral seal 9.

Figure 5:
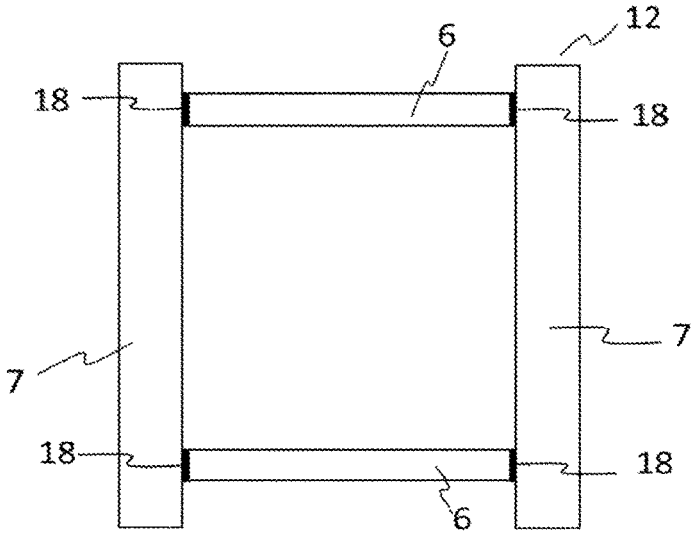
FIG. 5 illustrates another embodiment of the spacer frame 12 according to the invention.

FIG. 5 illustrates another implementation of a spacer frame 12 of a panel of the glass wall which takes up the following elements: two transparent vertical spacers 7 and two horizontal spacers 6. The vertical spacers 7 and the horizontal spacers 6 are connected by a tightness element 18.

Figure 6:
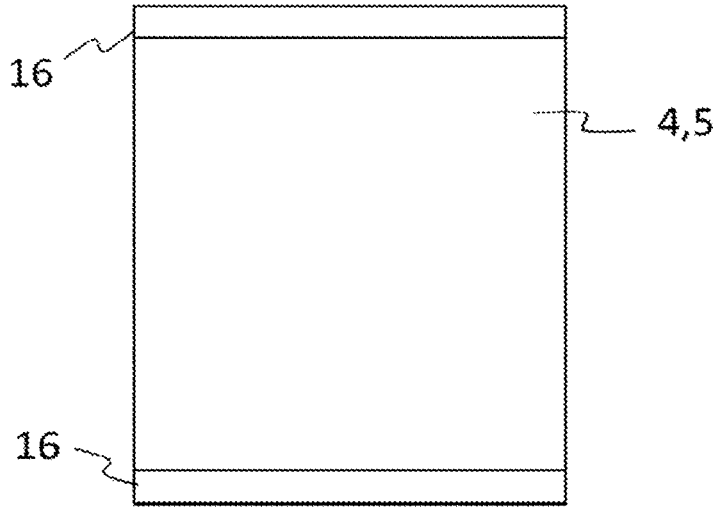
FIG. 6 represents a glass sheet of a panel covered with a decorative layer applied as a band in the vicinity of the horizontal edges of the panel.

FIG. 6 represents a glass sheet 4 or 5 of a panel covered with a decorative layer 16 applied as a band in the vicinity of the horizontal edges of the panel.

Figure 7:
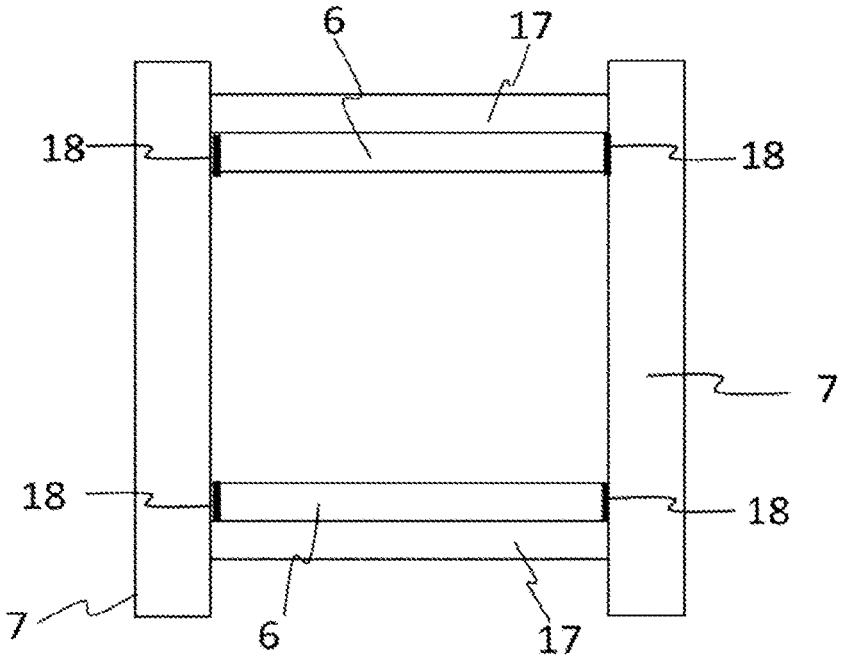
FIG. 7 illustrates a spacer frame according to FIG. 5 additionally comprising two stiffening elements glued over the whole of the length of the horizontal spacers.

FIG. 7 illustrates a spacer frame 12 according to FIG. 5 additionally comprising two stiffening elements 17 glued over the whole of the length of the horizontal spacers 6.

Figure 8:
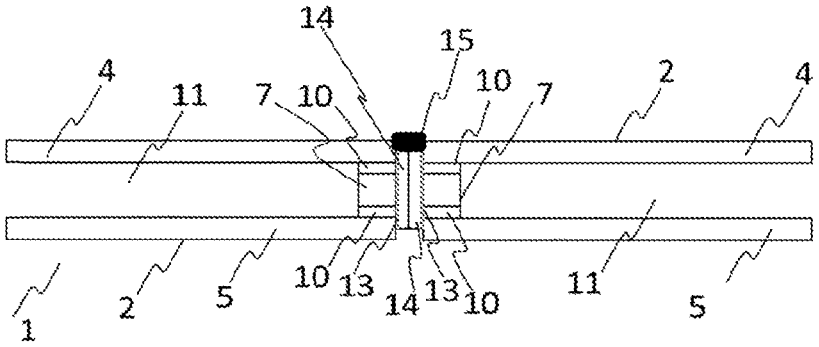
FIG. 8 illustrates a section in a glass wall according to a specific embodiment of the invention.

FIG. 8 illustrates a section in a glass wall according to a specific form of the invention corresponding to a curtain wall application. A glass wall 1 comprising two glass panels 2 is made out therein. Each glass panel 2 is composed of two glass sheets 4, 5, of a transparent vertical spacer 7, of a first double transparent vertical peripheral seal 10 on the glass sheet/transparent vertical spacer interfaces, of an internal space 11 and of a second non-transparent vertical peripheral seal 13. The glass wall 1 also comprises two seal bases 14 contiguous with the vertical edges of each glass panel 2 and not adherent to one another. Finally, the glass wall 1 comprises a tightness lining 15 located between the glass sheets 4, 4 of each panel 2 in contact with the atmosphere external to the building.

Figure 9:
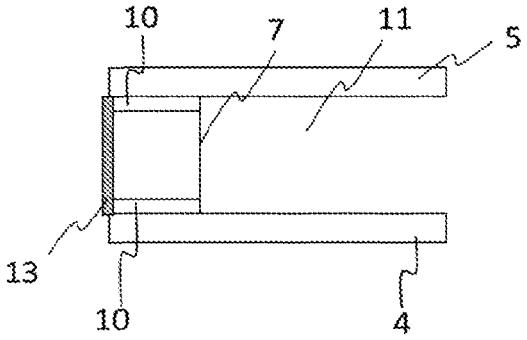
FIG. 9 illustrates another section along a plane AA in another embodiment of the panel of FIG. 2.

FIG. 9 illustrates another implementation of a section along a plane AA in the panel of FIG. 2. This figure describes the following elements: two glass sheets 4, 5, a transparent vertical spacer 7, a first transparent vertical peripheral seal 10 at each glass sheet 4, 5/transparent vertical spacer 7 interface and a second non-transparent vertical peripheral seal 13. The second non-transparent vertical peripheral seal 13 is contiguous with the internal surfaces of the two glass sheets 4, 5, with the edges of the double transparent vertical peripheral seal 10 and with the transparent vertical spacer 7.

Figure 10:
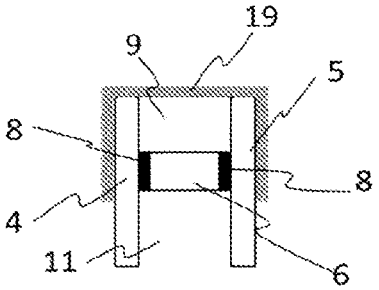
FIG. 10 illustrates another section along a plane BB in another embodiment of the panel of FIG. 2.

FIG. 10 illustrates another implementation of a section along a plane BB in the panel of FIG. 2. This figure describes the following elements: two glass sheets 4, 5, a horizontal spacer 6, a first horizontal peripheral seal 8 at each glass sheet 4, 5/horizontal spacer 6 interface, a second horizontal peripheral seal 9 and a third horizontal peripheral seal 19. The third horizontal peripheral seal 19 entirely covers the horizontal portions of the glass sheets 4, 5 and the second horizontal peripheral seal 9 and extends over the external faces of the glass sheets.

8. EXAMPLES

Example 1 in Accordance with the Invention

An insulating glass wall was assembled according to the following procedure.

Two insulating glass panels in the form of double glazings were selected in order to form a glass wall. They are formed:

- of a sheet of tempered soda-lime-silica float glass, ground on its edges, with a thickness of 8 mm and with dimensions of 1800 mm×1200 mm,
- of a laminated glass comprising 2 sheets of soda-lime-silica float glass with a thickness of 4 mm and with dimensions of 1800 mm×1200 mm and separated by a PVB sheet with a thickness of 2 mm and with the same dimensions,
- of a spacer frame which comprises two transparent vertical PMMA spacers (with a length of 1200 mm) and two non-transparent horizontal spacers of "warm-edge" type (with a length of 1180 mm).

Each transparent vertical PMMA spacer has a thickness of 12 mm and a height of 10 mm. A seal in the form of a double-sided acrylic adhesive tape 3M VHB® 4918 with a thickness of 2 mm and with a height of 10 mm was deposited at each transparent vertical spacer/glass sheet interface.

Each horizontal spacer is composed of a closed profile of "warm-edge" type made of polypropylene/stainless steel. The spacer is hollow and has, for dimensions, a length of 1180 mm and a thickness of 15 mm. The spacer is filled with desiccative material and each of its ends is connected to the transparent vertical spacers by a polyisobutylene-based mastic. The side faces of the profile are glued to the two glass sheets by means of a polyisobutylene-based mastic. The spacer frame was pressed against one of the glass sheets. The second glass sheet was deposited on the other face of the frame and pressed automatically by a vertical gas-pressing system. During this pressing stage, an insulating gas (argon) was inserted into the double glazing in a proportion of at least 85% by volume and 15% dry air. Any bubbling phenomenon at the acrylic adhesive tape/glass sheet interface was carefully avoided. The horizontal edges of the double glazing were subsequently glued with a Dow Corning DC® 3362 silicone mastic. This mastic also glued each horizontal spacer. The portion of the vertical edges of the glazing was covered with a single-faced aluminium adhesive tape. The adhesive of this tape is a combination of an acrylic seal contiguous with the aluminium tape and of a polyisobutylene-based mastic directly in contact with the assembly: transparent vertical spacer—first transparent peripheral seal—glass sheets.

The two constituent glass panels of the insulating glass wall were subsequently joined and connected by a seal base of non-adhesive transparent silicone type. The external glass sheets of each panel are sealed by a translucent MS ("modified silicone") Polymer mastic Sikaflex® from Sika.

The invention claimed is:

1. A glass wall of a building comprising at least two fixed glass panels, the panels being formed of a multiple insulating glazing formed of several glass sheets, the glazing comprising:

a. two horizontal spacers between each glass sheet;

b. at least one transparent vertical spacer on an edge contiguous with another panel;

c. a first double horizontal peripheral seal between the horizontal spacers and each glass sheet;

d. a second horizontal peripheral seal;

e. at least one first transparent double vertical peripheral seal between the transparent vertical spacer and each glass sheet;

f. an internal space between the glass sheets delimited by the horizontal spacers and vertical spacers comprising a covering of insulating gas, wherein, the horizontal spacer and vertical spacers are connected by at least one tightness element in order to form a spacer frame;

at least one second vertical peripheral seal contiguous with the first seal is non-transparent and leaktight to water vapour and to the insulating gas of the internal space;

two contiguous panels are connected by at least one seal base contiguous with the second vertical peripheral seal of each panel;

the second vertical peripheral seal contiguous with the first transparent vertical seal is free from tensile stress and/or from shear with respect to the adjacent panel;

a tightness lining is located between the glass sheets of two contiguous panels and is in contact with the seal base; and the glass wall is devoid of vertical rigid frame elements in a vicinity of an edge of the panels contiguous with the transparent spacer.

2. The glass wall according to claim 1, wherein the seal base is a flexible element, at least one surface of which in contact with the second peripheral seal of one of the two panels is juxtaposed without adhering with the second peripheral seal of the other panel.

3. The glass wall according to claim 1, wherein two contiguous panels are connected by two juxtaposed seal bases which do not adhere to one another.

4. The glass wall according to claim 1, wherein the seal base and the tightness lining are made of two different transparent resins.

5. The glass wall according to claim 1, wherein the second horizontal peripheral seal is a mastic having a structural function chosen from silicones, polyurethanes, polysulphides and modified silicones.

6. The glass wall according to claim 1, wherein the transparent vertical spacer comprises a polymer chosen from transparent polymers which are rigid at ambient temperature.

7. The glass wall according to claim 1, wherein the first transparent double vertical peripheral seal is selected from the group consisting of:

a. a double-sided tape, b. a polyisobutylene-based adhesive, and c. an adhesive comprising crosslinkable acrylic or crosslinkable epoxy.

8. The glass wall according to claim 1, wherein the first horizontal peripheral seal is formed from the group consisting of a polyisobutylene-based mastic, a double-sided tape made of acrylic polymer, rubber or silicone, and a combination thereof.

9. The glass wall according to claim 1, wherein the second vertical peripheral seal is a single-sided metallic adhesive tape optionally combined with at least one coating.

10. The glass wall according to claim 1, further comprising a third horizontal peripheral seal which covers the second horizontal peripheral seal and at least partially horizontal portions of the glass sheets.

11. The glass wall according to claim 1, wherein a primer is applied on at least one of the following surfaces:

a. the glass sheets at an interface with the first double transparent vertical peripheral seal, b. the transparent vertical spacer at an interface with the first double transparent vertical peripheral seal, and c. an edge face of the glass sheets.

12. The glass wall according to claim 1, wherein at least one glass sheet is tempered and/or laminated.

13. The glass wall according to claim 1, wherein at least one panel exhibits a heat transfer coefficient Ug ranging from 0.3 to 1.8 W/m2.

14. The glass wall according to claim 1, wherein at least one glass sheet of the glass panel is partially covered with a decorative layer selected from the group consisting of ceramic inks and organic inks.

15. The glass wall according to claim 14, wherein the horizontal spacers and the horizontal peripheral seals are masked by the decorative layer deposited on the glass sheet.

16. The glass wall according to claim 1, wherein the vertical spacers are connected to the horizontal spacers by at least one stiffening element.

17. A curtain wall, a glazing with bracing beam, or a glass roof, comprising the glass wall of claim 1.

18. The glass wall according to claim 1, wherein the double-sided tape comprises a material selected from the group consisting of acrylic polymer, rubber, and silicone.

* * * * *